US010337212B2

(12) United States Patent
Barron

(10) Patent No.: US 10,337,212 B2
(45) Date of Patent: Jul. 2, 2019

(54) SECURITY DEVICES

(71) Applicant: ZEAL INNOVATION LTD, Swansea (GB)

(72) Inventor: Neil Anthony Barron, Swansea (GB)

(73) Assignee: ZEAL INNOVATION LTD, Swansea (GB)

( * ) Notice: Subject to any disclaimer, the term of this patent is extended or adjusted under 35 U.S.C. 154(b) by 0 days.

(21) Appl. No.: 15/579,128

(22) PCT Filed: Jun. 3, 2016

(86) PCT No.: PCT/GB2016/051646
§ 371 (c)(1),
(2) Date: Dec. 1, 2017

(87) PCT Pub. No.: WO2016/193750
PCT Pub. Date: Dec. 8, 2016

(65) Prior Publication Data

US 2018/0171676 A1 Jun. 21, 2018

(30) Foreign Application Priority Data

Jun. 4, 2015 (GB) ..... 1509727.2

(51) Int. Cl.
*E05B 73/00* (2006.01)
*E05B 67/00* (2006.01)
(Continued)

(52) U.S. Cl.
CPC ..... *E05B 73/0005* (2013.01); *A45C 13/20* (2013.01); *D07B 1/005* (2013.01);
(Continued)

(58) Field of Classification Search
CPC ..... E05B 67/003; E05B 67/006; E05B 71/00; E05B 73/00; E05B 73/0005; E05B 73/0011; E05B 73/0029; E05B 73/007
See application file for complete search history.

(56) References Cited

U.S. PATENT DOCUMENTS 2,563,113 A 8/1951 Hindin et al.
3,756,008 A * 9/1973 Smith ..... B21F 3/02 140/149
(Continued)

FOREIGN PATENT DOCUMENTS

EP 0102933 A1 3/1984
EP 1102933 A2 5/2001
(Continued)

OTHER PUBLICATIONS

International Search Report and Written Opinion of the International Searching Authority for International Application No. PCT/GB2016/051646, dated Aug. 23, 2016.

*Primary Examiner* — Christopher J Boswell
(74) *Attorney, Agent, or Firm* — Marshall, Gerstein & Borun LLP

(57) ABSTRACT

A security device has a flexible strap (26) with a lock unit (28) attached at each end. The strap (26) comprises a plurality of longitudinally extending multi-filament cables or ropes (2) arranged in a substantially planar array embedded in an elastomeric material (4). The cables or ropes (2) have a coating of primer for creating a bond with the elastomeric material (4). The primer may be restricted to the external surface of the cables or ropes (2), or some of the surfaces of the filaments may be free of primer. This facilitates relative movement of the filaments during flexure or compression of the strap (26). Moreover, an extrusion process for manufacturing the strap (26) including a priming station (12) is disclosed.

27 Claims, 3 Drawing Sheets

(51) Int. Cl.

| | |
|---|---|
| ***E05B 71/00*** | (2006.01) |
| ***A45C 13/20*** | (2006.01) |
| ***D07B 1/16*** | (2006.01) |
| ***D07B 1/22*** | (2006.01) |
| ***D07B 1/00*** | (2006.01) |
| ***D07B 1/06*** | (2006.01) |

(52) U.S. Cl.

CPC ..... *D07B 1/06* (2013.01); *D07B 1/16* (2013.01); *D07B 1/162* (2013.01); *D07B 1/22* (2013.01); *E05B 67/003* (2013.01); *D07B 2201/102* (2013.01); *D07B 2201/104* (2013.01); *D07B 2201/1092* (2013.01); *D07B 2201/2087* (2013.01); *D07B 2201/2088* (2013.01); *D07B 2201/20907* (2015.07); *D07B 2205/2064* (2013.01); *D10B 2503/00* (2013.01); *E05B 71/00* (2013.01)

(56) References Cited

U.S. PATENT DOCUMENTS

| | | | | | |
|---|---|---|---|---|---|
| 3,991,445 | A * | 11/1976 | Pennell | E05B 73/0005 | 24/122.3 |
| 4,057,056 | A | 11/1977 | Payton | | |
| 4,103,410 | A * | 8/1978 | Pennell | E05B 73/0005 | 29/401.1 |
| 4,261,493 | A * | 4/1981 | Newman | A63C 11/025 | 224/257 |
| 5,177,986 | A * | 1/1993 | Jensen | A63C 11/021 | 428/100 |
| 5,327,752 | A * | 7/1994 | Myers | E05B 27/083 | 248/553 |
| 5,706,679 | A | 1/1998 | Zane et al. | | |
| 6,199,412 | B1 * | 3/2001 | Kennedy | A44B 11/14 | 224/568 |
| 6,510,717 | B1 | 1/2003 | Levi | | |
| 9,322,131 | B2 * | 4/2016 | Chuang | D07B 1/10 | |
| 9,828,724 | B2 * | 11/2017 | Kindstrand | D07B 1/18 | |
| 2002/0129628 | A1 | 9/2002 | Skalberg | | |
| 2005/0241348 | A1 | 11/2005 | Devecki | | |
| 2012/0042700 | A1 * | 2/2012 | Barron | E05B 17/106 | 70/15 |
| 2015/0082841 | A1 | 3/2015 | Lebeaume et al. | | |
| 2016/0348402 | A1 * | 12/2016 | Barron | E05B 67/003 | |
| 2017/0096841 | A1 * | 4/2017 | Hall | B60R 25/02136 | |

FOREIGN PATENT DOCUMENTS

| | | | |
|---|---|---|---|
| EP | 1172476 | A1 | 1/2002 |
| FR | 1239298 | A | 8/1960 |
| WO | WO-2010/103327 | A2 | 9/2010 |
| WO | WO-2015/087067 | A1 | 6/2015 |
| WO | WO-2016/067026 | A1 | 5/2016 |

* cited by examiner

SECURITY DEVICES

CROSS-REFERENCE TO RELATED APPLICATION

The present application is the US national phase of International Application No. PCT/GB2016/051646, filed Jun. 3, 2016, which claims priority to United Kingdom Application No. 1509727.2, filed Jun. 4, 2015. The priority application, GB 1509727.2, is hereby incorporated by reference.

This invention relates to security devices and particularly to straps for such devices. It has especial application in devices for securing baggage and light vehicles in the manner described in various Patent publications including International Specification No. WO2010/103327; our International Application No. PCT/GB2014/053646, and U.S. Pat. Nos. 5,706,679 and 6,510,717.

The present invention focuses on straps for use in devices of the kind referred to above, in which a plurality of wires or cables are embedded in an elastomeric material. Such straps are known from for example; European Patent Specification No. 1 102 933, to which reference is directed. Reference is also directed to U.S. Pat. No. 2,563,113 and French Patent No. 1,239,298 which disclose similarly embedded wire in flat belts or cables. U.S. Pat. No. 4,057,056 is also relevant in that it discloses a high strength steel cable having a continuous, flexible outer covering of vulcanised rubber. The disclosures of each of these documents and those referred to above, are hereby incorporated by reference.

There is an ongoing need to provide a security device comprising a strap with lock units at either end in which the strap is sufficiently resistant to cutting to discourage attempts to break it. More particularly, its cut resistance should be sufficient to hamper or prevent cutting to an extent that the process cannot be completed swiftly enough, if at all, to justify the risk involved in making the attempt. The present invention is a security device having a strap that presents an unstable target to a cutting device, be it a saw, a bolt cropper, a cable cutter or scissors, with a lock unit attached at either end of the strap.

In a manner similar to the strap of European Specification No. 1 102 933, the flexible strap in a security device according to the present invention comprises a plurality of longitudinally extending multifilament cables embedded in an elastomeric material. According to the invention the elastomeric material is thermoplastic or thermosetting; the cables are arranged in a substantially planar array; and the cables have a coating of primer for creating a bond with the material. Although not essential, it is desirable to restrict the primer coating to the external surface of the cables, or to ensure that some of the surfaces of the cable filaments within the strap are free of primer. This facilitates relative movement of the filaments during flexure or compression of the strap. A suitable primer is one sold by Lord Corporation under the Trade Mark CHEMLOK, which can be used with an adhesive, but the primer may also be elastomeric. The preferred elastomeric material for the surrounding mass is thermoplastic polyurethane.

The lock units at either end of the strap in a device of the invention may take any suitable form. A particularly preferred lock is described in our International Patent publication No. WO2016/067026, the contents whereof are hereby incorporated by reference. Particularly when the units lock together by engaging on a common axis, they are preferably attached to the strap at an angle; typically of 15-25°. This can facilitate both opening (unlocking) and closure (locking) of the device. Normally, the units are inclined in opposite senses, such that the bending of the strap required to close or lock the device is reduced by a small amount.

The cables in straps used in devices of the invention can take a variety of forms, and can include filaments having different tensile strengths. Each cable may itself comprise a plurality of multifilament wires, normally twisted around a core, and each wire may itself comprise multiple filaments twisted around a core. Each core, in either of these variants, may also comprise multiple filaments twisted around its own core. Typically the array will be of five or six cables which we have found to be most effective, but the number is not critical. Preferred cross sectional dimensions for the strap are in the range 4-6 cms wide and 0.8-1.2 cms thick; for the cables, 0.6-1.0 cm; and for single or multifilament wires within the cables, 1.5-3.0 mms. Typical diameters for the filaments in such multifilament wires will be in the range 0.15-0.35 mm.

The filaments of the strap cables are typically steel, normally galvanised but stainless steel can be used. High tensile metallic filaments are preferred, with tensile strengths in the range 2200 to 3000 MPa, in cables having an overall breaking strength of up to 30 KN. Some straps in devices of the invention, using six cables, can have a breaking strength of 170-180 KN. Reference is directed to U.S. Pat. No. 6,949,149, hereby incorporated by reference, which describes wires with diameters in the range 0.2 to 0.4 mm having such high tensile strengths. It refers to "High", "Super", "Ultra" and "Mega" Tensile strength carbon steels with minimum tensile strengths of 3400; 3650; 4000 & 4500 MPa@0.20 mm filament (wire) diameter respectively. Such filaments could be used in the straps of devices according to the invention, provided sufficient flexibility can be assured. Wires and filaments suitable for use in the straps of devices according to the invention are also available from Sandvik Materials Technology, part of Sandvik AB, of Sandviken, Sweden. Other materials can also be used as the filaments of the straps in devices of the invention, as can mixtures of different materials such as carbon fibre, Kevlar or a range of synthetic materials. The cables can of course comprise a mixture of metallic and non-metallic materials, and additional bulking materials such as mineral fibres can be included whatever form of filaments is adopted.

Because the elastomeric material of the straps is thermally reactive, the strap in a device of the invention preferably has an outer heat-proof coat. This may be a coating, or a sleeve which might be moulded or a fabric. A knitted fabric sleeve has some advantages by virtue of its ready elasticity and flexibility, providing an additional impediment to cutting by virtue of the mobility of its yarn components.

Straps in devices of the invention will generally have an elongate or rectangular cross-section, with a minimum thickness of elastomeric material over a cable. One preferred cross-section is flat or linear on one side but indented on the other side between the cables. Another is indented on both sides; a third is indented on both sides, but only between adjacent pairs of cables. It will be appreciated that the cross-section of the strap will determine its stiffness, or bending resistance which will be selected on the basis of its size and eventual use. As general guides, the minimum thickness of the strap between the cables is around half the diameter of a single cable; the preferred minimum spacing between the wires is around half the diameter of a single wire, and the strap cross-section has a width to thickness ratio in the range 5:1 to 8:1. The primed surface of a cable will normally be at least 1 mm from the outer surface of the strap.

When the strap in a device according to the invention is sought to be cut the mobility of the filaments in the cables within the elastomeric material hampers the engagement of a blade while their confinement in the material prevents their separation. As a consequence the strap cannot be broken in a single stroke or cut, and multiple attempts will initially at least, be unsuccessful. The bond between the cables and the material established by the primer restricts the movement of the cables within the strap, and as a consequence controls or determines the relative movement of the cable filaments. This is particularly the case when the cable filaments are twisted, either alone; as wires within the cables, or within wires comprising the cables as described above.

In a method of making a strap for a device according to the invention a plurality of multifilament cables coated with a primer are arranged in a planar array extending in a common longitudinal direction. The array of cables is drawn through a die with a mass of heated thermoplastic or thermosetting material which is then cooled with the cables embedded therein. The heated thermoplastic material is preferably under pressure while being forced into and through the die, typically at a temperature of 180-225° C. It can be pressurised by a screw extruder providing a 3:1 compression ratio. The method normally includes the preparatory step of first cleaning and then coating the surfaces of the cables with primer although cables pre-coated with primer can of course be used. Complementary lock units are then attached to the respective ends of the strap to complete the security device.

Further details of the invention will be apparent from the following description of preferred embodiments in which reference will be made to the accompanying schematic drawings wherein.

Figure 1:
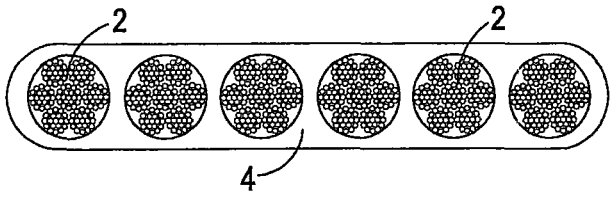
FIG. 1 is a cross-section of a strap for use in a device according to the invention.

The strap shown in FIG. 1 has an array of six cables 2 embedded in a cooled and cured elastomeric material 4. The strap shown is around 5 cms wide and around 1 cm thick; its cross-section has flat upper and lower faces as shown and is semi-circular on either side. Each cable has a diameter of around 6 mms, and the array is located centrally in the material leaving a minimum of at least 1 mm of material around each cable. The spacing between the cables is in the range 1.5-2.0 mm, and the spacing between the outermost cables and the outer extremity of the strap is around 2 mms. these dimensions can of course vary, but the ratio of strap width to thickness will normally be in the range 5:1 to 8:1.

Figure 2:
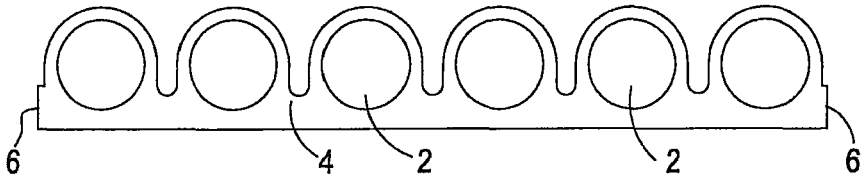
FIG. 2 is an enlarged cross-section of an alternative strap for use in a device of the invention.

The strap shown in FIG. 2 also has an array of six cables 2 embedded in a cooled and cured elastomeric material 4. however, in this embodiment the material is indented on one side between the cables. The resistance to bending of the strap is reduced by the removal of the mass from the one side, particularly around an axis on the other side. On either side of the strap the material is formed with a 2.5 mm shoulder 6. The cross-section is flat on its lower face with a minimum of around 1.5 mms between the lower face and each cable 4, and a minimum of around 1 mm over each cable on the upper face. The overall width of the strap is around 5 cms, and its thickness around 8 mms. The depth of each indent is around 5.4 mms, but where indentations are used in any strap of the invention, their depth is normally in the range 55-80% of the strap thickness, preferably 56-70%.

The elastomeric material is typically thermoplastic, but thermosetting materials can also be used in some applications. The preferred material is polyurethane. The strap as a whole is normally enclosed in a sleeve, or coated with an heatproof layer.

Figure 3:
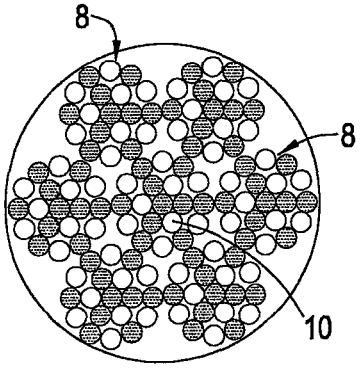
FIG. 3 is a further enlarged cross-section of one form of cable suitable for use in straps of the kind shown in FIGS. 1 and 2.

FIG. 3 shows a further enlarged cross-sectional view of a cable suitable for use in the straps of devices according to the invention. As can be seen it comprises multiple filaments which are themselves arranged in separate wires. The Figure shows six such wires 8 around a seventh core wire 10. Each wire itself consists of multiple filaments; the drawing shows nineteen, with eighteen around the nineteenth core filament. In each wire 8 and 10, the filaments are twisted around the nineteenth core filament, and the wires 8 are twisted around the core wire 10. We have found cables with seven wires performed well in tests. The number of filaments in each wire can vary. We have used nineteen in each wire, as illustrated, and seven in another trial, which also performed well. In a particular embodiment, in an indented strap of the kind illustrated in FIG. 2, each wire had seven 2.6 mm diameter wires with each wire consisting of seven 0.8 mm filaments. The filaments can be of the same material, normally metallic; steel, galvanised or stainless, but combinations of different materials can be used, and bulking fibres can be included.

Figure 4:
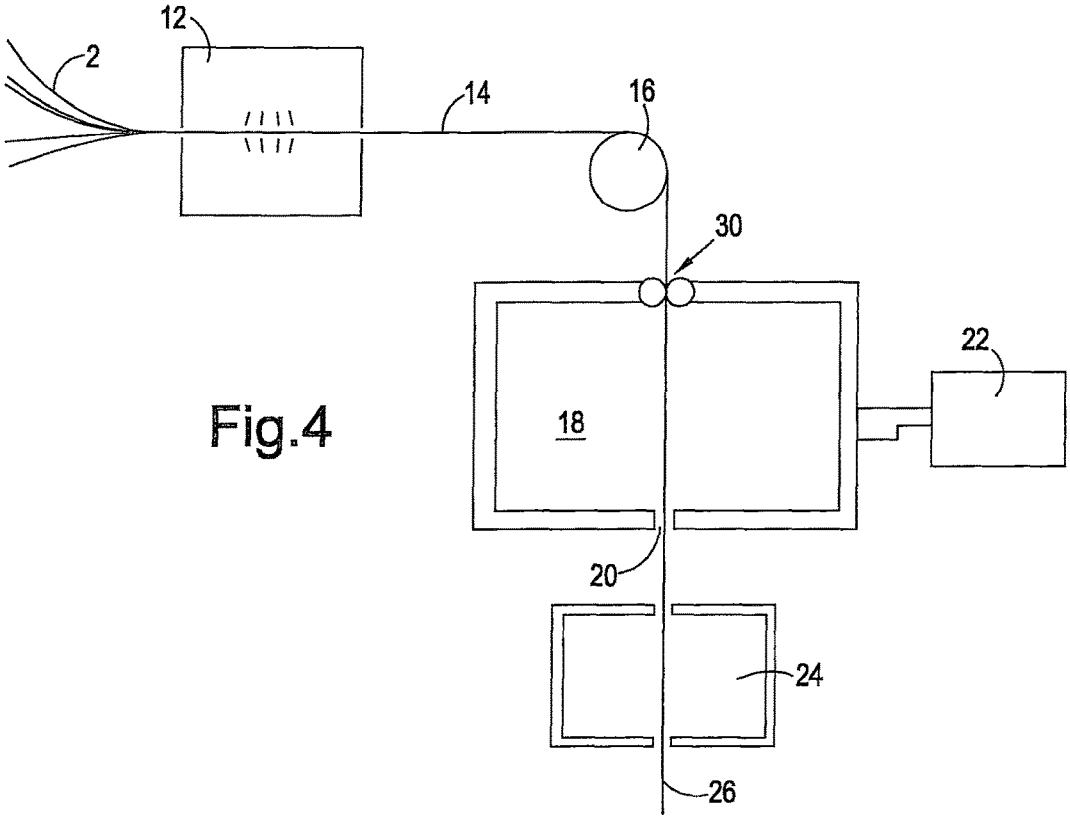
FIG. 4 illustrates a process for making a strap for use in a security device according to the invention.

A simple procedure for the manufacture of a strap according to the invention is illustrated in FIG. 4. Multifilament cables 2 with the chosen arrangement of filaments as discussed above are coated with a primer at a priming station 12 and delivered in a planar array 14 over a roller 16 to a chamber 18 containing the elastomeric material. The cables and their filaments will normally be cleaned just prior to entering the priming station, and an adhesive may also be added at this stage if needed. The array passes through the chamber and is drawn through a die 20 with the desired cross-section. The elastomeric material is delivered to the chamber 18 and kept under pressure by a screw conveyer 22 and thereby extruded though the die 20 at the same rate as the array 14. As it does so it bonds with the primed surfaces of the cables in the array 14, which bond is established as the material cools and sets in the stabiliser station 24. The resultant strap 26 can then be cut and incorporated in a security device of the invention by attaching a locking unit 28 (see FIG. 5) at either end. The entrance of the cable array to the chamber 18 is sealed by pressurised rollers 30, and at the die 20 by the material itself. The pressure and temperature of the material in the chamber will depend upon the nature of the material, but for polyurethane a temperature in the range 180-225° C. and the pressure generated by a 3:1 compression ratio are appropriate.

In preferred embodiments of the invention some of the surfaces of the cable filaments are left free of primer. This can be accomplished by coating only the outer surface of the cables and leaving the inner filaments. When the filaments themselves are formed into separate wires within the cables, the external surfaces of the wires can be coated, again leaving the internal filaments uncoated. The filaments without a primer coating are better able to move relative to each other, and this enhances the flexibility of the strap as a whole. This mobility is both longitudinal and lateral, assisting the straps resistance to cutting as the cables and/or wires will compress or shift in response to an attempt to cut the strap with for example a blade or saw.

Figure 5:
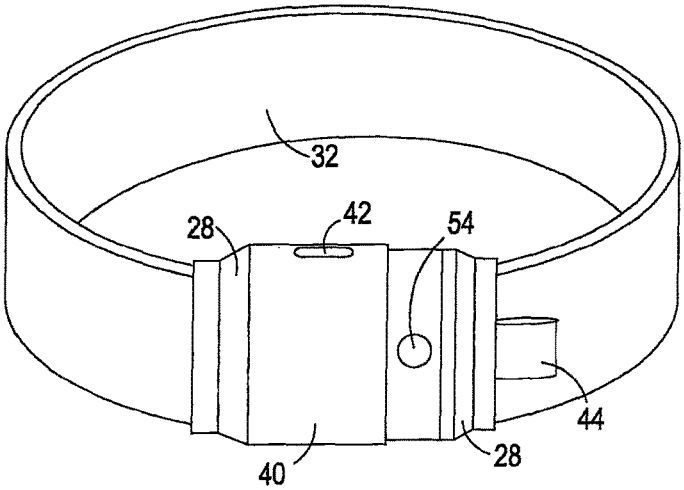
FIGS. 5 and 5A shows a security device incorporating a device according to the invention.
Figure 5A:
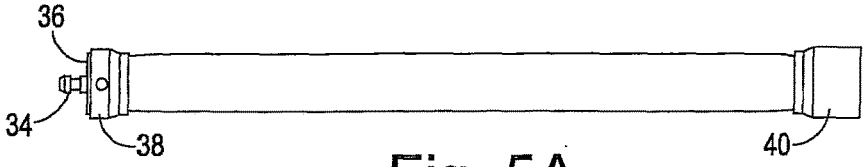

A completed security device according to the invention is illustrated in FIGS. 5 and 5A. The strap is enclosed in a knitted sleeve 32, and lock units 28 at either end of the strap are engaged to close the device as shown in FIG. 5. FIG. 5A shows the device open and laid flat. A typical length for the closed device, suitable for use as a bicycle lock, is 736 mm. As can be seen, one of the lock units has a male element 34 projecting from a shoulder 36 on body 38. When engaged with the other lock unit the element 34 and shoulder 36 are received in sleeve 40 with the element latching behind a releasable catch in the sleeve. The element can be released from the catch to unlock the device by a key (not shown) fitted in keyhole 42. A tab 44 is attached to one of the lock units to assist in their separation when the device is unlocked.

Figure 6:
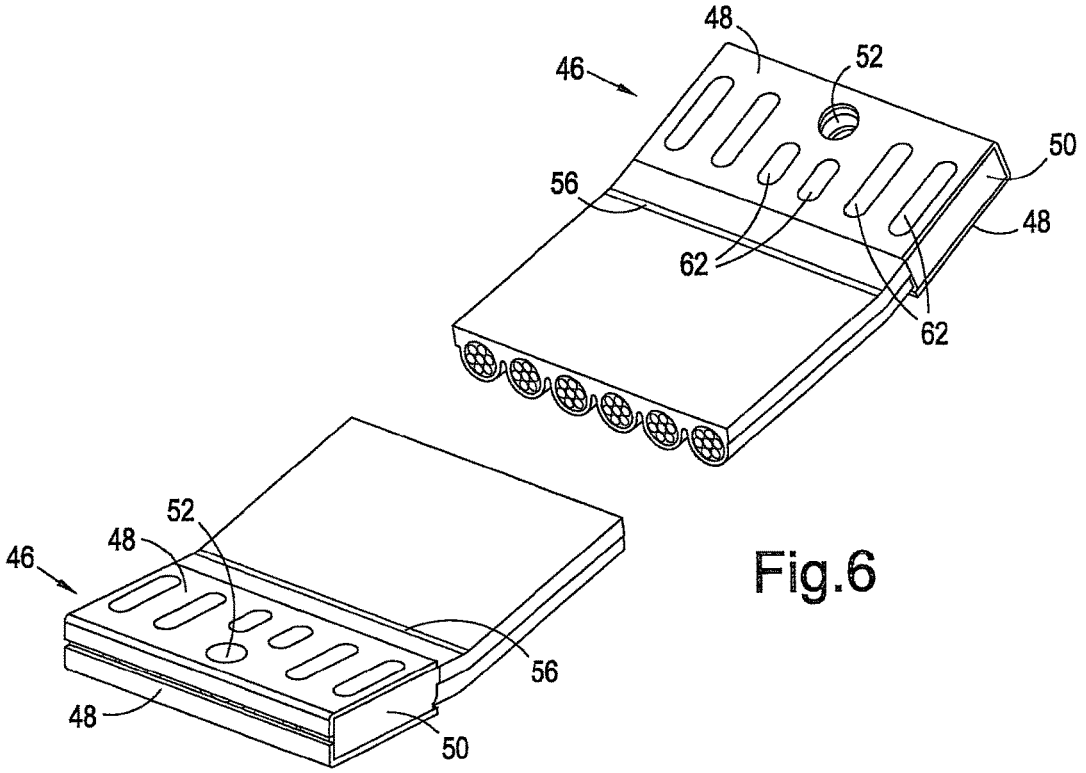
FIG. 6 is a perspective view of the ends of a strap for use in a device of the invention.

FIG. 6 shows the ends of a strap for use in a device of the invention with the central length omitted to show its cross section. Each end is received in and attached to a bracket 46 as described below. Each bracket 46 consists of matching metal pressings 48, normally of stainless steel, which may be closed by plates 50 at either side. The pressings are formed with openings 52 which combine to form a passage for a rivet by which the pressings are attached to respective lock units. While one rivet 54 is shown in FIG. 5, it is preferred that they not normally be visible in the completed security device. It will be appreciated that attachment mechanisms other than rivets can be used, bearing in mind that the mechanisms are preferably not to be seen. As can be seen, the brackets 46 project from the elastomeric material of the strap at a small angle; typically 10-25° from the strap axis. This can be established by setting the angle at a crease 56 prior to the final curing stage in the manufacture of the strap, and it will be understood in this respect that the requisite length of strap may be cut prior to final curing.

Figure 7:
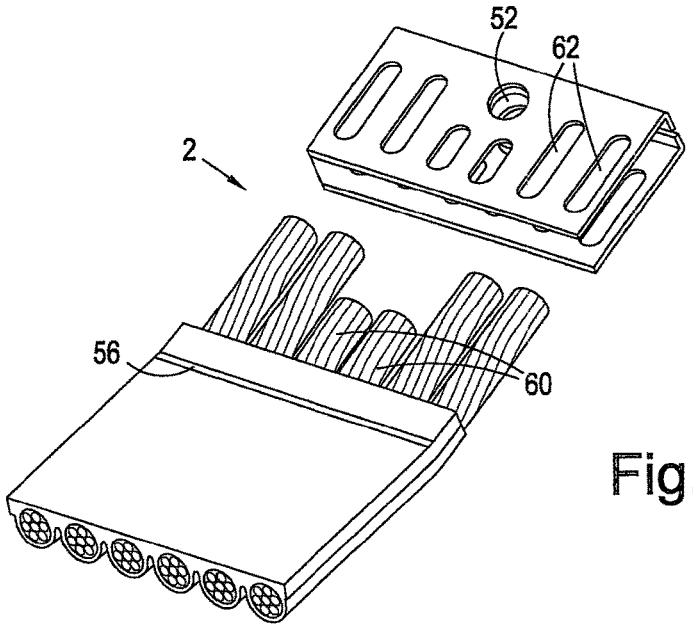
FIG. 7 shows an exploded view of one of the strap ends of FIG. 5, revealing the cable ends.

FIG. 7 illustrates one strap end with the bracket 46 shown separated. As can be seen, the elastomeric material 58 has been stripped back to expose the six cables 2, and the ends of the central cables 60 are cut back to free the space between the openings 52. The brackets can be attached to the exposed cables by suitable means such as welding or gluing, or crimping if the respective bracket is a unitary component. If the means is glue, then a high grade epoxy resin glue is preferred. If the means is welding, the MIG or TIG welding can be satisfactory. The slots 62, which might otherwise be omitted, are useful in this respect as they can be used to puddle weld the bracket 46, or the pressings 48 to the cables, burning off any coating on the cables in the process. A protective coating on the fitted brackets and cables can be added thereafter if required, by painting or dipping.

The invention claimed is:

1. A security device comprising a flexible strap with a lock unit attached at each end, the strap having a plurality of longitudinally extending multifilament cables arranged in a substantially planar array embedded in a thermoplastic or thermosetting elastomeric material, the cross-section of the strap being linear on one side of the array and having indentations on the other side of the array, the indentations extending along the strap between the cables; wherein the cables have a coating of primer.

2. A security device according to claim 1 wherein the elastomeric material is polyurethane.

3. A security device according to claim 1 wherein filaments having different tensile strengths are included in each cable.

4. A security device according to claim 1 wherein each cable comprises a plurality of multifilament wires.

5. A security device according to claim 4 wherein the wires are twisted around a core.

6. A security device according to any claim 5 wherein the core also comprises multiple filaments twisted around a core.

7. A security device according to any claim 4 wherein each wire itself comprises multiple filaments twisted around a core.

8. A security device according to claim 1 wherein the filaments of the multifilament cables are of different materials.

9. A security device according to claim 8 wherein the materials are metallic and non-metallic.

10. A security device according to claim 1 having a heatproof outer coat.

11. A security device according to claim 10 wherein the outer coat comprises a sleeve.

12. A security device according to claim 1 wherein the minimum spacing between the cables is half the diameter of a single cable.

13. A security device according to claim 1 wherein some of the filaments of the multifilament cables are free of primer.

14. A security device comprising a flexible strap with a lock unit attached at each end, the strap having a plurality of longitudinally extending multifilament cables arranged in a substantially planar array embedded in a thermoplastic or thermosetting elastomeric material, the cross-section of the strap having indentations on both sides of the array, the indentations extending along the strap between the cables; wherein the cables have a coating of primer.

15. A security device according to claim 14 wherein the minimum thickness of the strap between the cables is half the diameter of a single cable.

16. A security device according to claim 14 wherein the minimum spacing between the cable is half the diameter of a single cable.

17. A security device according to claim 14 wherein the cross-section of the strap has a width-to-thickness ratio in the range 5:1 to 8:1.

18. A security device according to claim 14 wherein at least some of the cables project at the ends of the strap for attachment to the lock units, and the projecting cables at each end of the strap are received and held in a bracket attached to the respective lock unit.

19. A security device according to claim 18 wherein the cables are held in the brackets by one of crimping, gluing and welding.

20. A security device according to claim 14 wherein some of the filaments of the multifilament cables are free of primer.

21. A method of making a security device wherein a plurality of multifilament cables coated with a primer and arranged in a planar array extending in a common longitudinal direction are drawn through a die with a mass of heated thermoplastic or thermosetting elastomeric material, which die has a cross-section that forms longitudinal indents on one side of the array between the multifilament cables, the elastomeric material then being cooled with the multifilament cables embedded therein to form a strap in which the primer enhances a bond between the cables and the elastomeric material; and attaching complementary lock units to the strap ends.

22. A method according to claim 21 wherein the heated elastomeric material is under pressure.

23. A method according to claim 21 wherein the heated elastomeric material is polyurethane.

24. A method according to claim 21 wherein projecting cables at each end of the strap are received and held in a bracket attached to the respective lock unit and the cables are held in the brackets by one of crimping, gluing or welding.

25. A method of making a security device wherein a plurality of multifilament coated with primer and arranged in a planar array extending in a common longitudinal are drawn through a die with a mass of heated thermoplastic or thermosetting elastomeric material, which die has a cross-section that forms longitudinal indents on one side of the array between the multifilament cables, the elastomeric material then being cooled with the multifilament cables embedded therein to form a strap in which the primer enhances a bond between the cables and the elastomeric material; and attaching complementary lock units to the strap ends, the method including the preparatory step of coating the surfaces of the cables with primer while ensuring that some of the surfaces of the cable filaments are free of primer.

26. A method of making a security device wherein a plurality of multifilament coated with primer and arranged in a planar array extending in a common longitudinal are drawn through a die with a mass of heated thermoplastic or thermosetting elastomeric material, which die has a cross-section that forms longitudinal indents in the elastomeric material on both sides of the array between the multifilament cables, the elastomeric material then being cooled with the multifilament cables embedded therein to form a strap in which the primer enhances a bond between the cables and the material; and attaching complementary lock units to the strap ends.

27. A method according to claim 26 including the preparatory step of coating the surfaces of the multifilament cables with primer whilst ensuring that some of the surfaces of the cable filaments are free of primer.

* * * * *